US006182673B1

(12) United States Patent
Kindermann et al.

(10) Patent No.: US 6,182,673 B1
(45) Date of Patent: Feb. 6, 2001

(54) DUMP FACILITY FOR CASSETTE SEWAGE TANKS

(75) Inventors: Mike Kindermann, Moenchengladbach; Dieter Kolodziej, Willich; Michael Schinkmann, Kaarst, all of (DE); Edward F. McKiernan, Big Prairie, OH (US)

(73) Assignee: Mike Kindermann Marketing/Vertriebs GmbH, Willich (DE)

( * ) Notice: Under 35 U.S.C. 154(b), the term of this patent shall be extended for 0 days.

(21) Appl. No.: 09/289,631

(22) Filed: Apr. 12, 1999

(51) Int. Cl.[7] ..... B08B 3/02

(52) U.S. Cl. ..... 134/21.1; 134/24; 134/166 R; 134/155; 134/169 R

(58) Field of Search ..... 134/166 R, 167 R, 134/168 C, 167 C, 169 C, 166 C, 169 R, 62, 200, 201, 170, 171, 21.1, 24, 155, 150

(56) References Cited

U.S. PATENT DOCUMENTS

| | | | | |
|---|---|---|---|---|
| 1,462,917 | * | 7/1923 | Miller | 134/150 |
| 2,057,152 | * | 10/1936 | Lenschow | 134/167 R |
| 3,122,151 | * | 2/1964 | Chambers | 134/167 R |
| 3,633,594 | * | 1/1972 | Boundy | 134/150 |
| 3,801,991 | | 4/1974 | Fulton et al. . | |
| 4,054,149 | * | 10/1977 | Nelson | 134/167 C |
| 4,058,412 | * | 11/1977 | Knapp et al. | 134/62 |
| 4,667,351 | * | 5/1987 | Williams | 134/166 R |
| 4,776,631 | | 10/1988 | Sargent et al. . | |
| 4,805,652 | * | 2/1989 | Hartley et al. | 134/166 R |
| 4,868,932 | * | 9/1989 | Thoma et al. | 134/169 R |
| 4,905,325 | * | 3/1990 | Colditz | 134/169 R |
| 4,944,048 | | 7/1990 | Sargent et al. . | |
| 4,967,776 | * | 11/1990 | Folmar | 134/169 R |
| 5,031,249 | | 7/1991 | Sargent . | |
| 5,186,195 | * | 2/1993 | Wall | 134/166 R |
| 5,210,901 | * | 5/1993 | Cooper | 134/166 R |
| 5,408,704 | | 4/1995 | Bailey et al. . | |
| 5,463,887 | * | 11/1995 | Vasseur | 134/167 R |
| 5,524,655 | * | 6/1996 | Powers et al. | 134/168 R |
| 5,613,510 | * | 3/1997 | Proctor | 134/166 R |
| 5,621,924 | | 4/1997 | Friedman et al. . | |
| 5,640,643 | * | 6/1997 | Hoitz | 134/166 R |
| 5,642,746 | * | 7/1997 | Sayce | 134/168 R |
| 5,876,511 | * | 3/1999 | Till . | |
| 5,996,600 | * | 12/1999 | Ostry | 134/179 R |
| 6,006,766 | * | 12/1999 | Soulages | 134/166 R |

FOREIGN PATENT DOCUMENTS 5-261353 * 10/1993 (JP) .

OTHER PUBLICATIONS

European Patent Office 82,557 134/167R, Jun. 1983.*

* cited by examiner

*Primary Examiner*—Frankie L. Stinson
(74) *Attorney, Agent, or Firm*—Nixon & Vanderhye P.C.

(57) ABSTRACT

A dump facility for RV sewage-containing tanks allows the tanks to be emptied in a simple and hygienic manner. A container which can receive a tank includes a connector for making a liquid tight seal with an outlet from the tank when it is received by the container. A flexible conduit is connected to the connector and transports sewage from the tank to a disposal location, and a spray head may be mounted to the connector to spray cleaning liquid into the tank within the container. The container is mounted for movement about a generally horizontal axis between the first position in which a tank may be readily inserted into the container, and a second position in which sewage from the tank may flow by gravity through the connector and the flexible conduit. Rotation of the tank about the axis may be provided manually or by a reversible powered element (such as a motor with associated sprockets and chain). The container is preferably mounted within a cabinet having a roller blind door closing the open front of the cabinet, and access to the door, and/or movement of the container about the axis, may be provided by a conventional token or money activated control.

20 Claims, 6 Drawing Sheets

Fig. 3
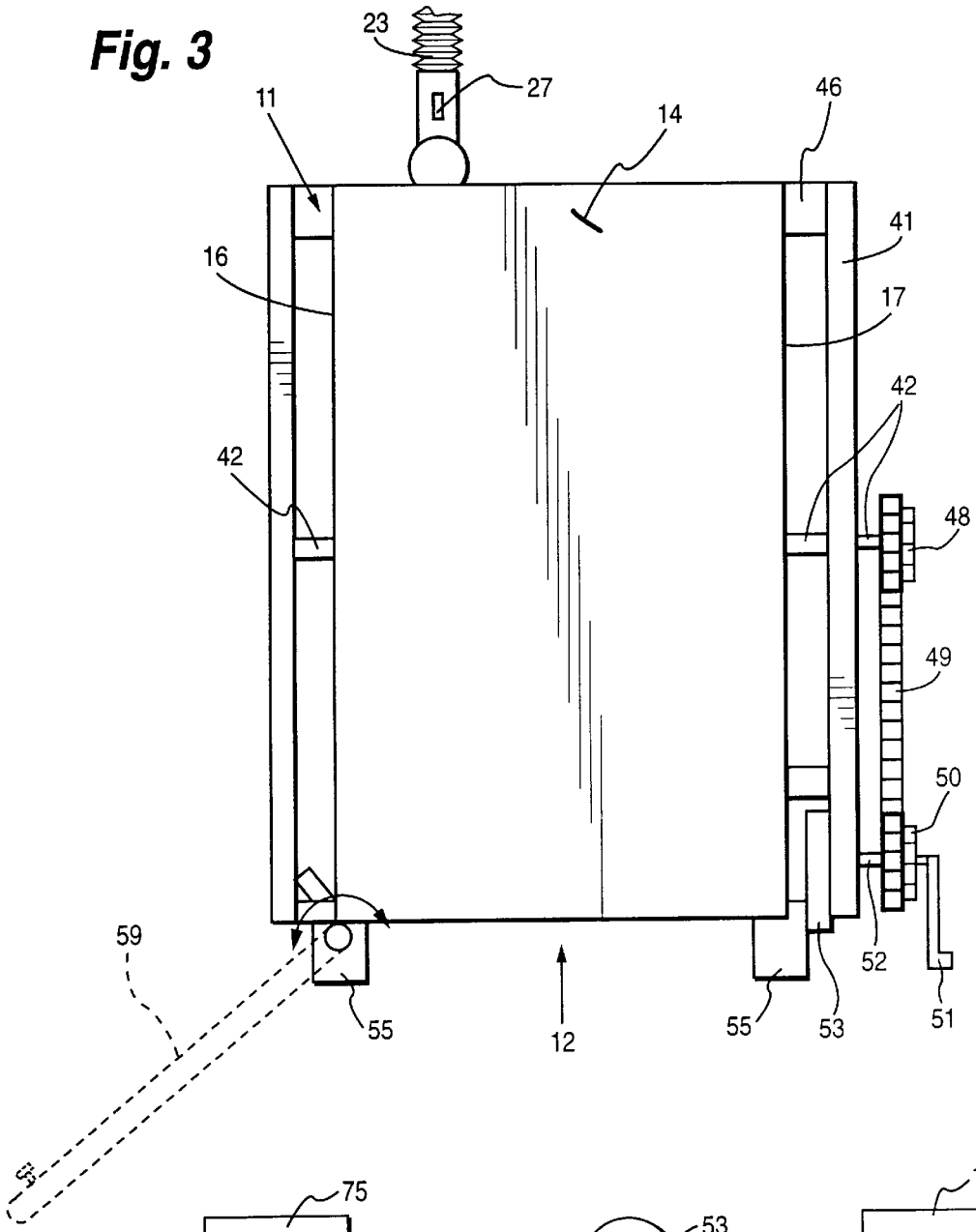
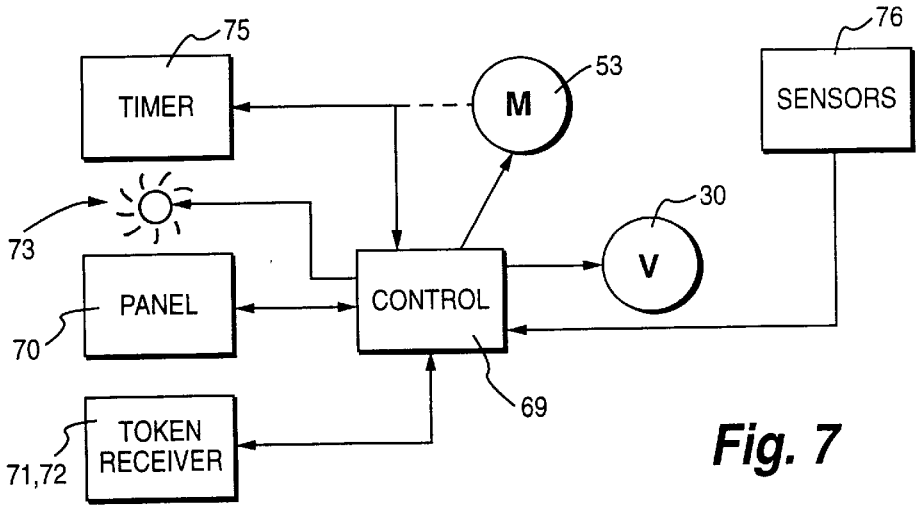
Fig. 7

DUMP FACILITY FOR CASSETTE SEWAGE TANKS

BACKGROUND AND SUMMARY OF THE INVENTION

In recreation vehicles (RV), also known as caravans, having toilets, a sewage-containing tank (often called a cassette tank, or a holding tank) are provided for storing sewage on-board the vehicle. Periodically the sewage-containing tank must be emptied. This is typically done at a campground by opening an outlet to the tank and allowing sewage from the tank to flow into a drain, a very unpleasant and often less than hygienic task.

According to the present invention a dump station for RV sewage-containing tanks, and a method of dumping sewage from such tanks, are provided which alleviate the unpleasantness associated with the tank dumping to some extent, and also do so in such a manner that a campground owner may provide this service without having to man the dumping facility. The invention is particularly useful for cassette tanks that are commercially manufactured by Electrolux and Thetford, and/or as shown in (or adapted from) U.S. Pat. Nos. 4,776,631, 4,944,048, and 5,031,249. However, the invention may be adapted to virtually any type of sewage-containing tank for an RV or caravan, such as the tanks illustrated in U.S. Pat. Nos. 5,621,924, 5,408,704, and 3,801,991, or DE 4003555.

According to one aspect of the present invention a dump station for RV sewage-containing tanks having an outlet, is provided. The dump station comprises: A container which can receive an RV sewage-containing tank, the container including a connector for making a substantially sealed engagement with the outlet of an RV sewage-containing tank received by the container. A flexible conduit connected to the connector, which conduit is capable of transporting sewage from the tank to a disposal location. And, means for mounting the container for movement between a first position in which the connector is generally horizontal, to a second position in which the connector is generally vertical and sewage from the tank may flow by gravity (typically primarily or substantially exclusively) through the container outlet into the connector and flexible conduit connected thereto so that the tank may be substantially drained of sewage.

The connector preferably comprises an inlet and an outlet, the inlet comprising a generally funnel-shaped flexible element of resilient material (e.g. natural or synthetic rubber or a resilient plastic). The dump station may further comprise a spray head mounted to the connector between the inlet and the outlet and positioned to effect spraying of liquid (preferably water, or water with a cleaning solution in it) through the connector into an RV tank received by the container. The spray head is preferably connected to a water conduit from a source of water under pressure, and a manually or preferably automatically operated valve is disposed in operative association with the conduit and spray head so that when the valve is opened liquid passes through the conduit to the spray head and is sprayed through the connector into an empty RV tank to be cleaned.

The container may comprise an open or openable (e.g. closed by a pivoting or sliding door) front end, a rear end comprising a rear wall which mounts the connector, and a bottom wall. The bottom wall may have slide tracks for guiding movement of the sewage-containing tank into the container, and a positive stop for stopping the penetration of the tank into the container at a position where the tank outlet has sealed with the connector.

The means for mounting the container may comprise any conventional structure which is capable of mounting the container so that it is safely and effectively movable between a position facilitating insert of the tank into the container, and a position where a tank within the container can drain sewage therefrom through the connector and the flexible conduit. While a wide variety of structures are suitable for this purpose, in one embodiment the mounting means comprises a pair of shaft stubs extending outwardly from side walls of the container to define a generally horizontal axis about which the container is rotatable from a first position in which the rear wall is substantially vertical, to a second position in which the rear wall is substantially horizontal. Stops may stop the container in the second position so that there is a slope of a few (e.g. about 2–3) degrees of the tank bottom (at that position), facilitating drainage of the sewage and cleaning liquid therefrom.

Rotation about the axis may be accomplished manually, or by powered elements (such as an electric motor, hydraulic or pneumatic cylinders, etc.). For example a first sprocket or pulley may be connected to one of the shaft stubs defining the axis of rotation, and a second sprocket or pulley may be mounted on a stationary support, the sprockets or pulleys connected together by a chain or belt. The second sprocket can be rotated either by a hand crank, or by a reversible motor or other powered element to slowly rotate the container (and tank within it) between the first and second positions, and then ultimately back to the first position. Preferably positive stops are provided on a stationary frame which limit the movement of the container to the first and second positions. The motor may be operable in response to a token or money (coin or bills) activated control. The flexible conduit may be connected up to a city sewage system, septic tank system, or any other suitable sewage treatment facility, while the conduit for the spray head is connected up to any suitable source of fresh water under pressure, such as a city water supply.

The entire structure described above may be mounted within a cabinet that has an open front end that can be opened or closed by a door, such as a metal roller blind.

According to another aspect of the present invention, a method of dumping sewage from an RV tank having an outlet and containing sewage, using a container having an outlet hose and an open or openable position, is provided. The method preferably comprises substantially sequentially: (a) Inserting the tank into the container through the open or openable position. (b) Effecting a substantially liquid-tight seal between the tank outlet and the container outlet hose. (c) Mechanically rotating the container about a substantially horizontal axis so as to cause sewage in the tank to flow through the outlet hose, out of the tank, to substantially empty the tank. (d) Mechanically rotating the container about the substantially horizontal axis back to a position for ready tank withdrawal. And, (e) withdrawing the tank from the container through the open or openable position.

The method preferably further comprises, after (c), (f) spraying a cleaning liquid into the tank to clean the inside of the tank, the liquid flowing out the outlet hose. The method is further defined so that (f) is practiced before (d) while the tank is positioned with the outlet near or at the bottom of the tank. In the practice of the method (c) and (d) may be practiced by utilizing a powered structure, and in response to a token or money-receiving actuator. In the method (b) is preferably effected substantially automatically by the practice of (a).

According to another aspect of the present invention a dump station is provided comprising the following components: A cabinet having an open front end which may be closed by a movable door. Disposed within the cabinet a container which can receive an RV sewage-containing tank, the container having an open or openable front end, a rear end to which an outlet hose is operatively connected, a bottom having tracks for receipt of an RV sewage-containing tank and a stop for stopping penetration of the tank into the container. The container mounted for rotation about a generally horizontally axis from a first position in which the rear wall is generally vertical, to a second position in which the rear wall is generally horizontal and sewage can flow out of the tank disposed within the container through the outlet hose. And, a spray head operatively connected to the rear wall of the container for spraying a cleaning liquid into a tank received by the container.

It is the primary object of the present invention to provide for the dumping of sewage from RV sewage-containing tanks in a procedure and utilizing an apparatus having enhanced functionality and hygiene. This and other objects of the invention will become clear from an inspection of the detailed description of the invention, and from the appended claims.

BRIEF DESCRIPTION OF THE DRAWINGS

FIG. 3 is a top plan view of the container and associated equipment within the cabinet of the dump station of FIGS. 1 and 2;

FIG. 7 is a schematic illustration of one embodiment of the interconnection of various operable components of the apparatus.

DETAILED DESCRIPTION OF THE DRAWINGS

Figure 1:
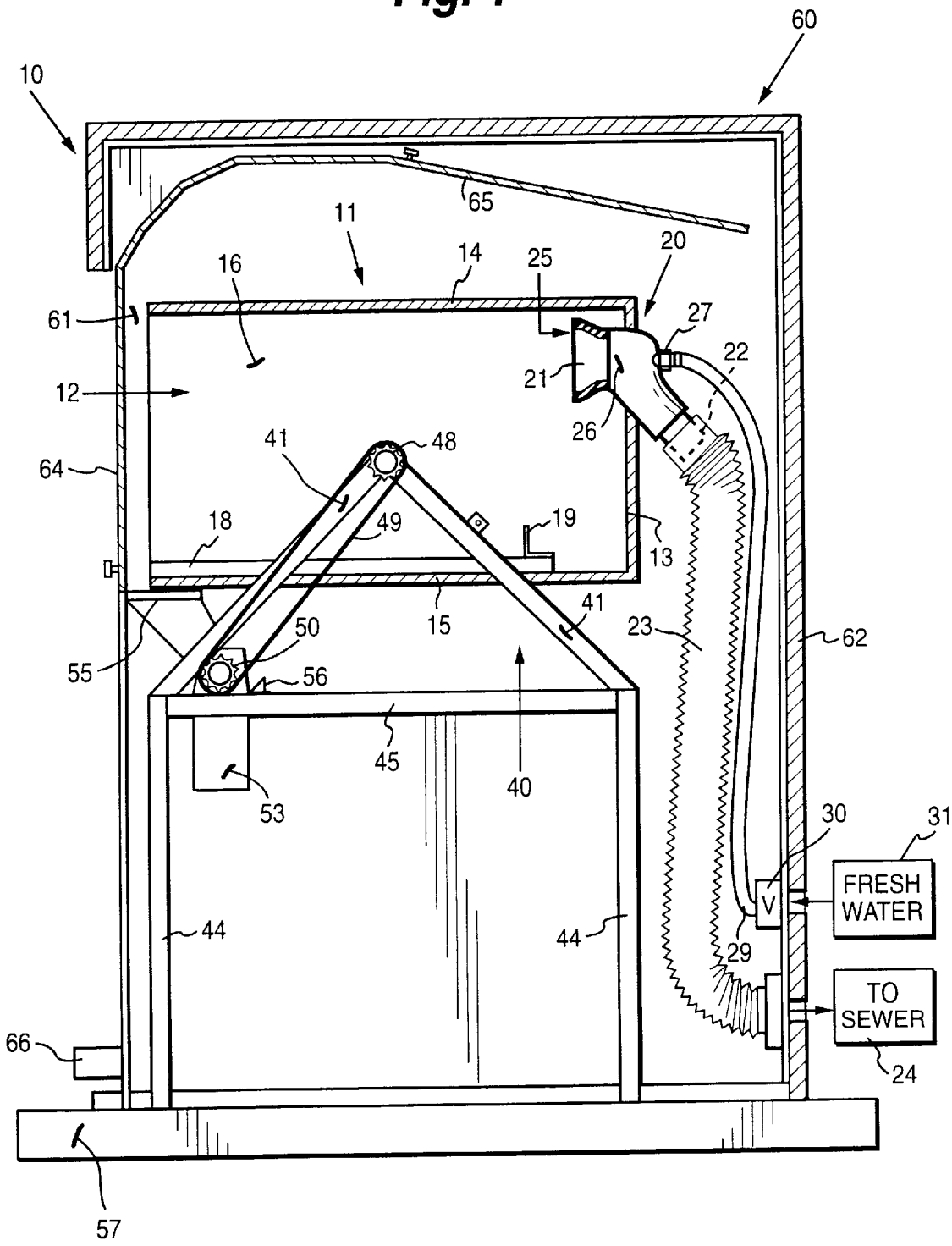
FIG. 1 is a side view, partly in cross-section and partly in elevation, of an exemplary embodiment of a dump station for RV sewage-containing tanks according to the present invention.
Figure 2:
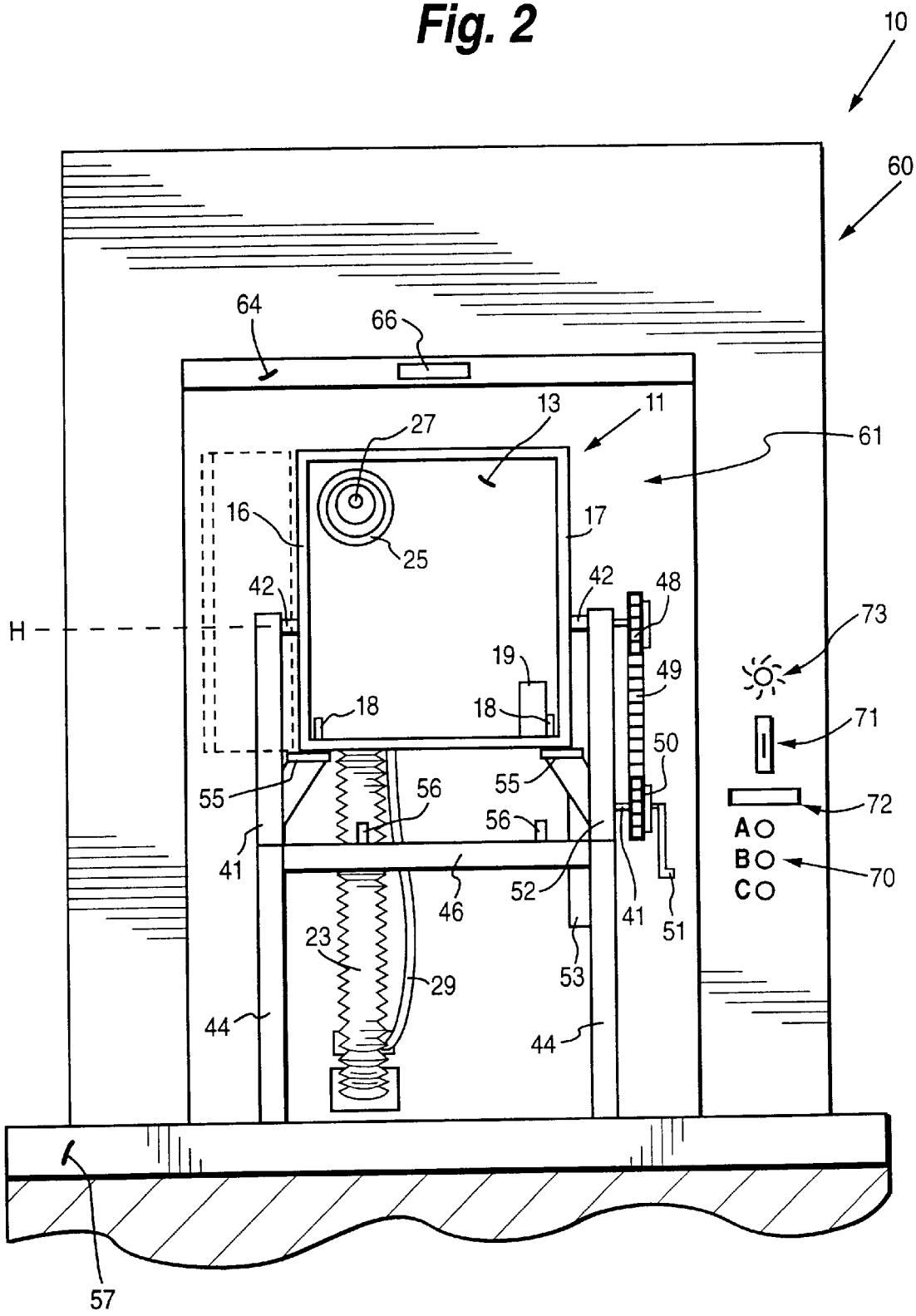
FIG. 2 is a front end view of the dump station of FIG. 1 with the roller blind open to allow a clear view of the interior.

An exemplary dump station according to the present invention is shown generally by reference numeral 10 in FIGS. 1 and 2. The dump station 10 includes a container 11 which can receive an RV sewage-containing tank (such as those manufactured and sold by Electrolux and Thetford and known as cassette tanks, or other sewage holding tanks or the like that are typically used with RVs or caravans, including tanks such as shown in U.S. Pat. Nos. 4,776,631, 4,944,048, and 5,031,249 , through an open or openable front end 12 of the container 11. The container 11 includes a rear end/wall 13, a top 14, a bottom 15, and sides 16 and 17 (see FIGS. 1 through 3). In order to facilitate movement of a conventional RV sewage-containing tank into the open interior of the container 11 through the open or openable front end 12 thereof, tracks 18 (see FIGS. 1 and 2) may be mounted on the bottom 15, and preferably a stop 19 is provided to stop movement of the tank into the container 11 at a desired position.

The container 11 also includes a connector 20 for making a substantially liquid-tight sealed engagement with the outlet of a conventional RV sewage-containing tank. The connector 20 preferably comprises an inlet 21 and an outlet 22, and the outlet 22 is connected to a flexible conduit/hose 23. The hose 23 in turn is connected to—as schematically illustrated at 24 in FIG. 1—a city sewage system, a septic field, or any other suitable sewage disposal or treatment facility. The flexible conduit/hose 23 may be of any conventional type which will readily flex and allow passage of sewage or other liquid or slurries therethrough, yet can accommodate movement of the connector 20 between first and second positions thereof (compare FIG. 1 and FIG. 5).

The connector 20 preferably comprises at the inlet 21 thereof a generally funnel-shaped flexible element 25 of resilient material. For example the element 25 may be of synthetic or natural rubber, or a resilient plastic material, and it is adapted in all of size, position, and construction, to mate with the outlet of a conventional sewage treatment tank and make a substantially liquid tight seal therewith.

The connector 20 also includes a body 26, defining the inlet 21 and the outlet 22, which typically is of more rigid material than the generally funnel-shaped element 25, and a spray head 27 is operatively mounted to the connector 20 preferably at the body 26 between the inlet 21 and the outlet 22, and positioned to effect spraying of liquid through the connector inlet 21 into an RV tank received by the container 11. The liquid spray head 27 is of any conventional type suitable for this purpose and is connected by flexible conduit/hose 29 to a source of cleaning liquid under pressure, such as the conventional source of clean water illustrated schematically at 31 in FIG. 1 (e.g. city water supply, or a tank containing water with a cleaning solution and a pump at the outlet of the tank). A valve 30 is operatively associated with the conduit 29 and the head 27 to either allow or prevent the flow of liquid to the spray head 27. While the valve 30 is shown mounted at the opposite end of the container 29 from the spray head 27 in the FIG. 1 embodiment, it is to be understood that the valve 30 can be mounted at any other position, including directly to the spray head 27. The valve 30 may be manually operable, but preferably is a conventional automatically operable (e.g. solenoid operated) valve.

Figure 4:
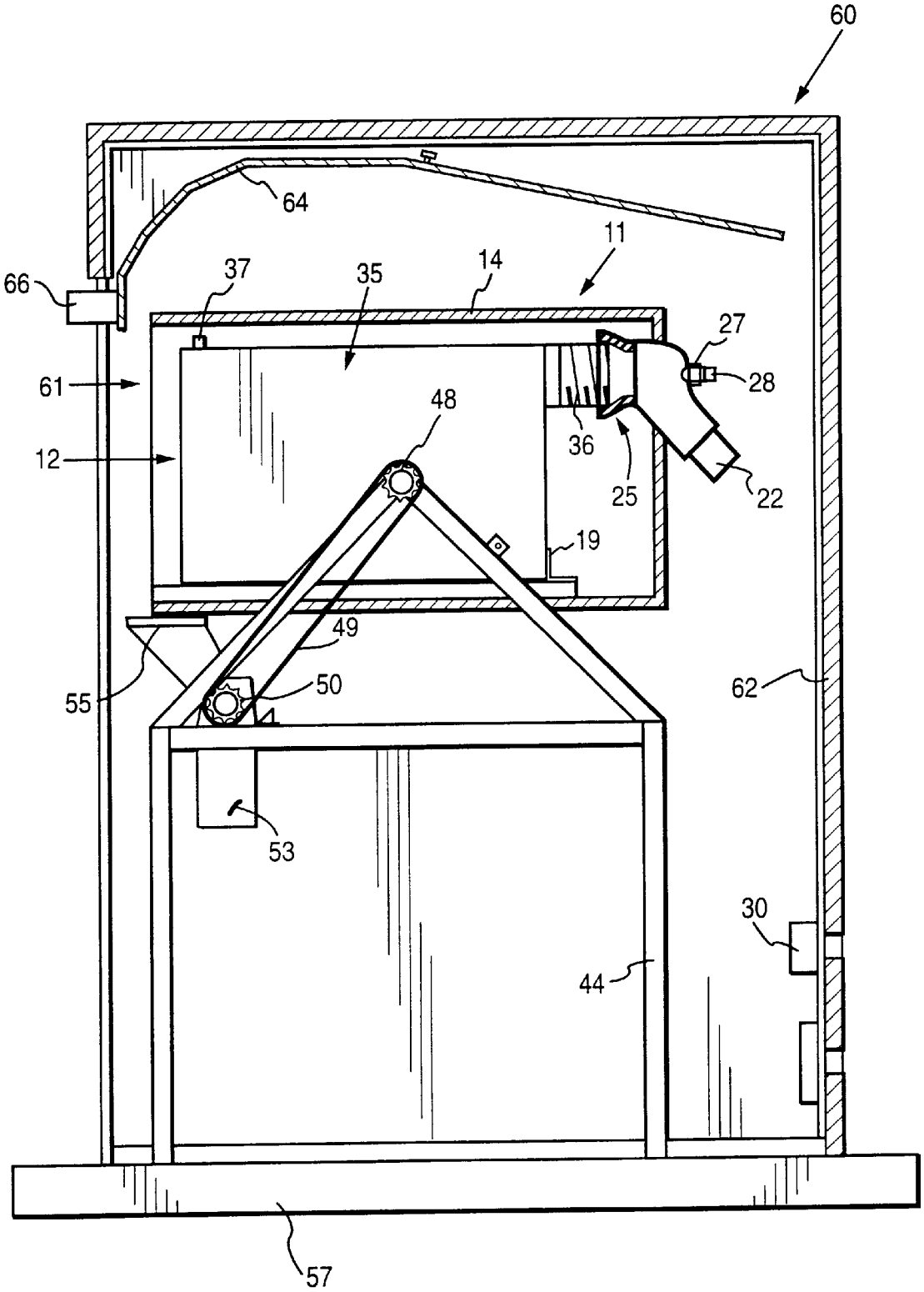
FIG. 4 is a view like that of FIG. 1 only showing an RV sewage-containing tank inserted in the container, and with the hoses removed for clarity of illustration.
Figure 5:
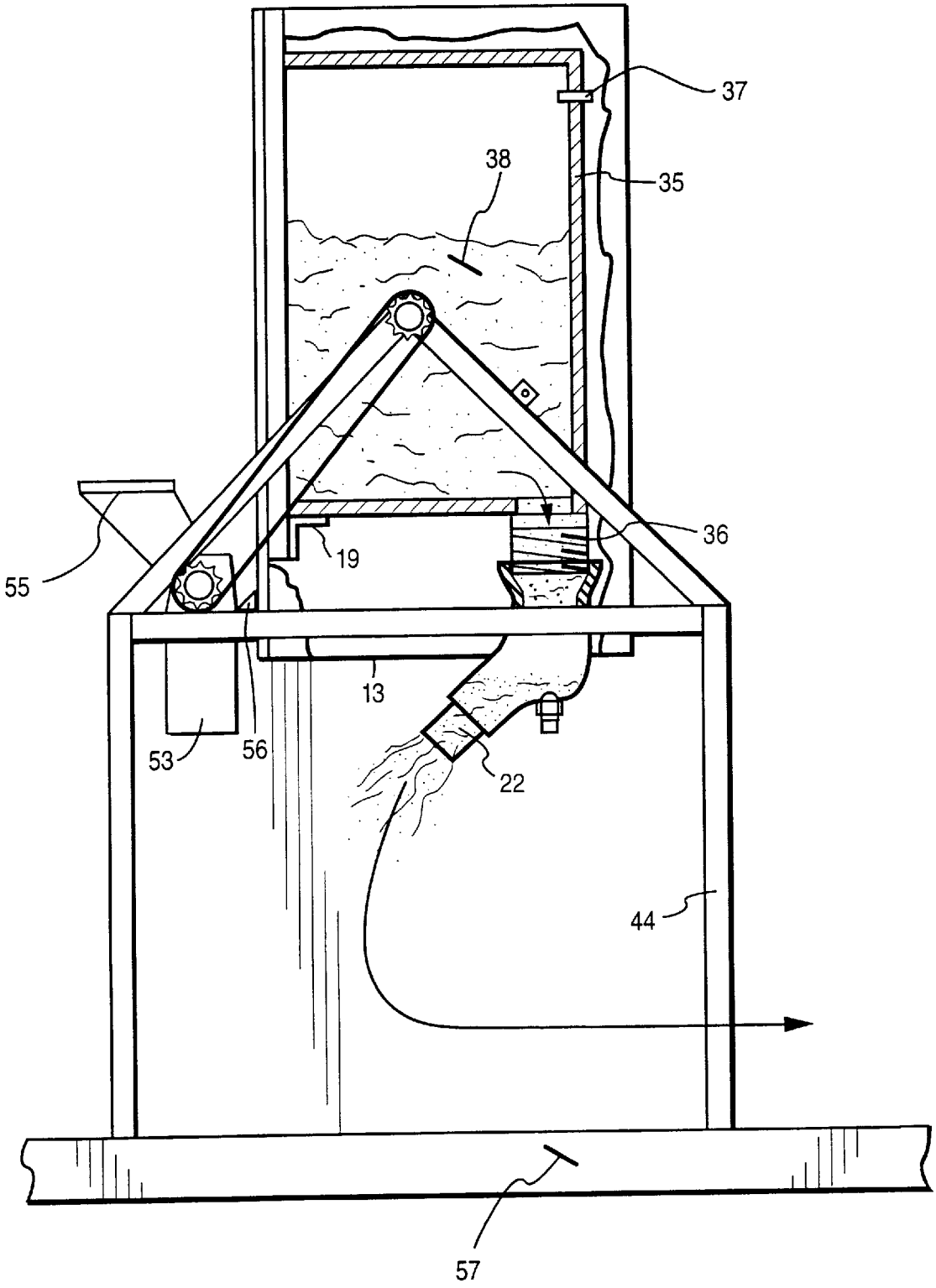
FIG. 5 is a view like that of FIG. 4, but with the cabinet and hoses removed for clarity of illustration, showing the tank in cross-section, and illustrating the dumping position of the tank.
Figure 6:
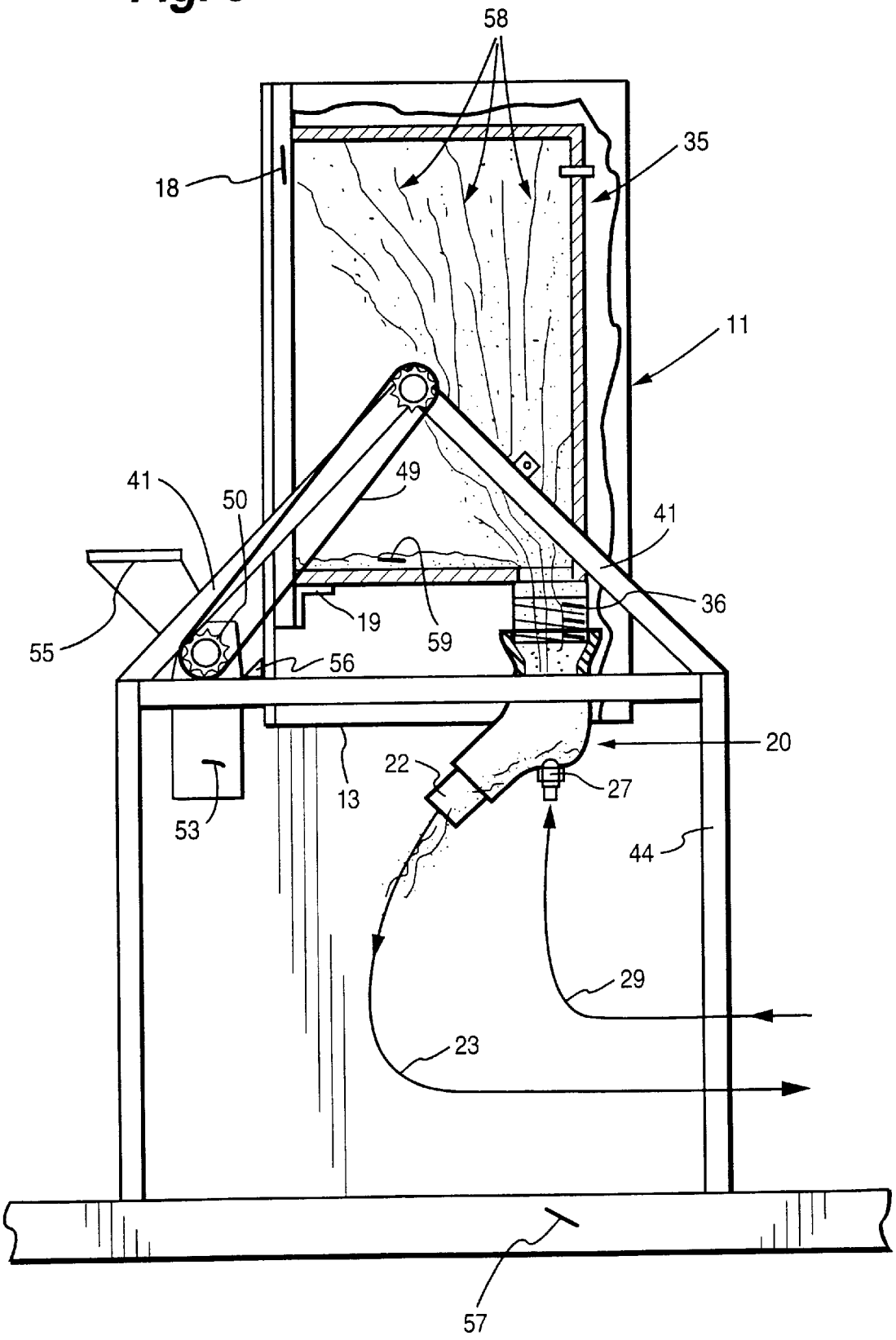
FIG. 6 is a view like that of FIG. 5 only showing the cleaning action of the tank after the sewage has been dumped therefrom.

The station 10 is shown receiving a conventional tank 35 within the container 11 in FIGS. 4 through 6. The tank 35 is an RV sewage-containing tank, such as described in the examples above, having an outlet 36 which makes a substantially liquid tight seal with the generally funnel-shaped flexible element 25. The tank 35 typically includes a vent 37 and other conventional elements (not shown).

The station 10 further comprises means for mounting the container 11 for movement between a first position (FIGS. 1 through 4) in which the connector 20 is generally horizontal, to a second position (FIGS. 5 and 6) in which the connector is generally vertical and sewage 38 from the tank 35 may flow by gravity (typically primarily or substantially exclusively) into the connector 20 and flexible conduit 23 connected thereto so that the tank 35 may be substantially drained of sewage. The flow of sewage 38 (see FIG. 5) out of the tank 35 may be solely by gravity, or may be assisted in other ways, such as by pressurizing the open space above the sewage (see FIG. 5) when the tank 35 is in the second position, connecting up the conduit 23 to a source of vacuum, or in other suitable conventional manners.

While the means for mounting the container 11 for movement between the first and second positions of FIGS. 4 and 5, respectively, may be any suitable conventional structure which is capable of accomplishing that purpose, in the exemplary embodiment illustrated in the drawings such means are shown generally by reference numeral 40. The means 40 may include a pair of support arms 41 mounted on opposite sides of the container 11 (see FIGS. 2 and 3) each having at their apex a shaft stub 42 that is journalled in the arms 41 and thereby mounts the container 11, via the side walls 16, 17 thereof, for rotation about a substantially horizontal axis H (see FIGS. 2 and 3). The arms 41 are preferably mounted on a stationary frame so that the axis H is sufficiently above the ground (or the bottom of a hole in the ground) to allow movement of the container 11 between the positions of FIGS. 4 and 5, respectively. For example this may be accomplished by utilizing the frame legs 44, and the two sets of cross horizontal supports 45, 46. All of the structures 41, 44, 45, 46 may, for example, be made of welded steel, aluminum or other metal, or any other suitable material.

While rotation of the container 11 about the axis H may be accomplished manually, just by a user grasping and rotating it, preferably the container 11 is rotated about the axis H in a controlled manner, either by hand or powered. This may be accomplished, in one simple way, by the exemplary mechanical means illustrated most clearly in FIGS. 1 through 3. While the mechanical means may take any conventional form, such as any types of gears, pulleys, belts, blind cylinders, levers, cables, or the like, in the embodiment illustrated in the drawings a first sprocket 48 is in line with and operatively connected to the shaft 42 adjacent the container wall 17 and connected thereto for rotation therewith, and the first sprocket 48 is connected by a chain 49 to a second sprocket 50 which is mounted stationarily by (but rotatable with respect to) the frame components 45, etc. Rotation of the sprocket 50 may be by the handle 51, the sprocket 50 mounted on a shaft 52 (see FIGS. 2 and 3) journalled in a portion of the frame (e.g. 45 or 46), or rotation of the sprocket 50 may be effected by a powered element, such as the electric motor 53 (or any suitable conventional alternative thereto such as a pneumatic cylinder, hydraulic cylinder, or the like). The motor 53 is reversible and preferably has associated gear reducers so that the sprocket 50 is rotated very slowly when moving the container between the first position of FIG. 4 and the second position of FIG. 5, and vice versa (e.g. taking 10–60 seconds to move between the positions of FIGS. 4 and 5). The motor 53 is mounted on the frame 44, 45, 46 by any suitable conventional structure such as brackets or flanges.

The station 10 also includes stops, such as illustrated at 55 and 56 and seen most clearly in FIGS. 1 and 2, which stop movement of the container 11 between the first position (stops 55) and the second position (stops 56). The stops 55, 56 are stationarily connected to the frame components 41, 45, 46, etc. by any suitable conventional structure such as arms, brackets, or the like. Typically the stop 55, 56 operable surfaces are approximately 86–94° apart, the first and second positions of FIGS. 4 and 5, respectively, typically being between about 88 and 93° apart (e.g. about 90–93° apart). That is in the first position of FIG. 4 the rear wall 13 is substantially (but not necessarily exactly) vertical, while in the second position of FIG. 5 the wall 13 is substantially (but not necessarily exactly) horizontal.

Mounting means 40 preferably are mounted on a relatively even horizontal surface, such as a concrete slab 57 or the like. Or all or most of the structure below the open end 12 may be mounted below ground so that lifting of the tank 35 is minimized or substantially eliminated.

When the spray head 27 is provided, it is utilized to clean the interior of the tank 35 once it has been substantially emptied of the sewage 38. This may be accomplished while the tank 35 is in the second position, as illustrated in FIG. 6, or alternatively or in addition the tank 35 may be moved (by rotating the container 11) back to the first position of FIG. 4 where at least some of the cleaning action takes place, and then rotated back to the position of FIG. 6 to drain. FIG. 6 illustrates the situation, however, where after substantially all of the sewage 38 has drained from the tank 35 clean water under pressure is sprayed by the spray head 27 into the tank interior, as illustrated by the water sprays 58 in FIG. 6, hitting many parts of the interior walls of the tank 35, and draining down to the bottom to form a pool 59 which flows into the outlet 36, then passes through the connector 20 and the flexible conduit 23 to sewer 24. In order to facilitate this motion, it is preferred that in the FIG. 6 position, when the container 11 abuts the stop 56, that the rear wall 13 is not exactly horizontal, but is two or three degrees past horizontal so that there is a slight slope to the bottom tank wall (as illustrated in FIG. 6) so that the liquid in the pool 59 will flow to the outlet 36.

Once the tank 35 interior has been cleaned and drained, the container 11 is rotated back to the first position in FIG. 4 (by crank 51 or motor 53), and the tank 35 is withdrawn from the container 11.

In the preferred embodiment of the station 10, a cabinet or shed 60 is provided surrounding the container 11, mounting means 40, and associated structures, as seen in FIGS. 1, 2, and 4 (the cabinet 60 being removed for clarity of illustration in FIGS. 2, 5, and 6). The cabinet 60 has an open front end 61, and preferably has a rear wall 62 in which the connections for the sewer 24 and fresh water 31 are provided (and on which the valve 30 may be mounted). A door (or doors) 64 may close the open front end 61. For example the door may be a conventional steel roller blind 64 which moves on a conventional track 65, and may have a handle 66 to allow movement thereof between the closed (FIG. 1) and open (FIGS. 2 and 4) positions. The roller blind 64 and track 65 are shown only schematically in the drawings. It is to be understood that they are conventional. Also any other suitable door may be provided, including a sliding door, or one that is rolled up when powered, or one similar to a conventional garage door. The door 64 may be opened manually using the handle 66, or by a motor (such as in a conventional garage door opener).

A common controller, such as a computer control, is illustrated schematically at 69 in FIG. 7, and is operatively associated with all of the powered components of the station 10. For example as illustrated in FIGS. 2 and 7 a control panel 70 may be provided with various buttons that may be actuated to open the door 64 (either unlock it or automatically open it), actuate the motor 53 to rotate the container 11, actuate the valve 30 to spray cleaning liquid into the tank 35, etc. Access to the control panel 70 may be controlled utilizing a conventional token or money receiving actuator, such as illustrated schematically at 71, 72 in FIGS. 2 and 7, it being understood that any conventional token or money operated activator that is suitable may be provided for that purpose. An indicator light 73 also may be provided indicating various levels of operation of the equipment in the dump station 10. A timer 75 may separately be provided for operating the motor 53 (e.g. returning it from the FIG. 6 to the FIG. 4 position after a predetermined period of time), or cooperating through the control 69, or as part of the control 69. The timer 75 may provide control so that the container 11 is held in the second, dumping, position of FIG. 5 for a predetermined period of time before being rotated back to the first position of FIG. 4, or before actuator of the valve 30 to spray the liquid streams 58 into the interior of the tank 35, and for the length of operation of the valve 30 to effect spraying, and then to allow drainage of the liquid 59 that has accumulated before rotation back to the first position of FIG. 4. Alternatively, or in addition, any suitable conventional sensor(s) 76 (illustrated schematically in FIG. 7) may be provided for sensing the positions of the container 11, whether there is still sewage in the tank 35, etc. The sensor(s) 76 may be optical, weight sensitive, or the like.

Utilizing the dump station as described above a method is provided comprising: (a) Inserting a tank 35 (typically by manually lifting it, or utilizing an assist, or pushing up a ramp) into the open front end 12 of a container 11, typically by moving the tank 35 along the tracks 18 until stopped by the stop 19 (see FIG. 4). (b) Effecting a substantially liquid tight seal between the tank outlet 36 and the container outlet hose 23 (e.g. by making a seal utilizing the generally funnel-shaped flexible and resilient element 25). The seal-effecting step preferably is provided simultaneously with the insertion of the tank 35, occurring automatically by the outlet 36 being moved into a position in association with the funnel 25. However, manual operation may be allowed (by providing the openings in the walls 14, 16, 17 for example) to facilitate or provide the seal. (c) Mechanically (e.g. by the handle 51, the motor 53, or the like, including the sprockets 48, 50 and chain 49) rotating the container 11 about a substantially horizontal axis X so as to cause sewage 38 in the tank 35 (see FIG. 5) to flow through the outlet hose 23 out of the tank 35, and substantially empty the tank of sewage. (d) Mechanically rotating (again by the handle 51, motor 53, and/or associated structures) the container 11 about the axis H back to a position for ready tank withdrawal (see FIG. 5). And, (e) withdrawing the tank 35 from the container 11, e.g. by the owner of the RV grasping the tank 35 and pulling it out of the container 11 through the open or openable (e.g. by opening the door 59 shown in dotted line in FIG. 3) front end 12 thereof.

The method further preferably comprises, after (c) (and typically between (c) and (d), although the tank may be rotated back to the position of FIG. 4, and then back to the position of FIG. 6, if desired) (f) spraying a cleaning liquid (e.g. from source 31) into the tank 35 interior to clean the inside of the tank, the liquid flowing (as indicated at 59) out the outlet hose 23. In the preferred embodiment (f) is practiced before (d) while the tank 35 is positioned with the outlet 36 near the bottom of the tank 35. In the method (c) and (d) are preferably practiced utilizing a powered element (e.g. motor 53, etc.), and may be practiced in response to a token or money operated control 71, 72.

It will thus be seen that according to the present invention a simple, effective, low labor, and hygienic apparatus and method are provided for facilitating the dumping of sewage from RV or caravan sewage-containing tanks, such as cassette tanks or holding tanks. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A dump station for RV sewage-containing tanks having an outlet, comprising:

a container which can receive an RV sewage-containing tank, said container including a connector for making a substantially sealed engagement with the outlet of an RV sewage-containing tank received by said container;

a flexible conduit connected to said connector, which conduit is capable of transporting sewage from the tank to a disposal location; and means for mounting said container for movement between a first position in which said connector is generally horizontal, to a second position in which said connector is generally vertical and sewage from the tank may flow by gravity through the container outlet into said connector and flexible conduit connected thereto so that the tank may be substantially drained of sewage.

2. A dump station as recited in claim 1 wherein said connector comprises an inlet and an outlet, said inlet comprising a generally funnel shaped flexible element of resilient material.

3. A dump station as recited in clam 2 further comprising a spray head mounted to said connector between said inlet and said outlet and positioned to effect spraying of liquid through said connector inlet into an RV tank received by said container.

4. A dump station as recited in claim 3 further comprising a liquid conduit connected to said spray head for transporting cleaning liquid to said spray head, and an automatically operated valve operatively connected to said liquid conduit and said spray head.

5. A dump station as recited in claim 1 wherein said container comprises an open or openable front end, said connector mounted on a rear end of said container, substantially opposite said front end.

6. A dump station as recited in claim 5 wherein said means for mounting said container comprises: means for mounting said container for rotation about a substantially horizontal axis so that said rear end moves from a position in which it is substantially vertical to a position in which it is substantially horizontal; and mechanical means for rotating said container about said axis.

7. A dump station as recited in claim 6 wherein said mechanical means comprises a first sprocket or pulley aligned with said axis, a second sprocket or pulley mounted on a stationary support, a chain or belt extending between said sprockets or pulleys, and a reversible powered element for rotating said second sprocket or pulley to effect rotation of said first sprocket or pulley.

8. A dump station as recited in claim 7 further comprising a token or money-actuable control for controlling movement of said means for mounting said container between said first and second positions, said control controlling said powered element.

9. A dump station as recited in claim 6 further comprising positive stops which engage said container to limit rotation of said container when in said first and second positions.

10. A dump station as recited in claim 9 wherein said container comprises a bottom having a track for guiding movement of the tank into the container, and a stop for stopping movement of the tank into the container once the tank outlet has made a substantially liquid-tight seal with said connector.

11. A dump station as recited in claim 9 wherein said stops stop movement of said container in said second position so that there is a slope of a few degrees of said tank bottom facilitating drainage of sewage and cleaning liquid therefrom.

12. A dump station as recited in claim 5 wherein said container comprises a bottom having a track for guiding movement of the tank into the container, and a stop for stopping movement of the tank into the container once the tank outlet has made a substantially liquid-tight seal with said connector; and wherein flow from the tank outlet in said second position is substantially exclusively by gravity.

13. A dump station as recited in claim 5 further comprising a cabinet surrounding said container, flexible conduit, and means for mounting said container, and including a roof.

14. A dump station as recited in claim 13 wherein said cabinet comprises an open front end, and a roller blind that may be moved from a position closing said open front end to a position exposing said open front end.

15. A method of dumping sewage from an RV tank having an outlet and containing sewage using a container having an outlet hose and an open or openable position, comprising substantially sequentially:

(a) inserting the tank into the container through the open or openable position;

(b) effecting a substantially liquid-tight seal between the tank outlet and the container outlet hose;

(c) mechanically rotating the container about a substantially horizontal axis so as to cause sewage in the tank to flow through the outlet hose, out of the tank, to substantially empty the tank;

(d) mechanically rotating the container about the substantially horizontal axis back to a position for ready tank withdrawal; and (e) withdrawing the tank from the container through the open or openable position.

16. A method as recited in claim 15 further comprising, after (c), (f) spraying a cleaning liquid into the tank to clean the inside of the tank, the liquid flowing out the outlet hose.

17. A method as recited in claim 16 wherein (f) is practiced before (d) while the tank is positioned with the outlet near or at the bottom of the tank.

18. A method as recited in claim 15 wherein (c) and (d) are practiced by utilizing a reversible powered element, by initiating actuation by said powered element by using a token or money.

19. A method as recited in claim 15 wherein (b) is effected substantially automatically by the practice of (a).

20. A dump station for RV sewage-containing tanks having an outlet, comprising:

a cabinet having an open front end which may be closed by a movable door;

disposed within said cabinet a container which can receive an RV sewage-containing tank, said container having an open or openable front end, a rear end to which an outlet hose is operatively connected, a bottom having tracks for receipt of an RV sewage-containing tank, and a stop for stopping penetration of the tank into said container;

said container mounted for rotation about a generally horizontally axis from a first position in which said rear wall is generally vertical, to a second position in which said rear wall is generally horizontal and sewage can flow out of said tank disposed within said container through said outlet hose; and a spray head operatively connected to said rear wall of said container for spraying a cleaning liquid into a tank received by said container.

* * * * *